US006626348B2

(12) United States Patent
Kitamura

(10) Patent No.: US 6,626,348 B2
(45) Date of Patent: Sep. 30, 2003

(54) STAPLER WITH BRAKING MECHANISM

(75) Inventor: Takuya Kitamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 25 days.

(21) Appl. No.: 09/886,906

(22) Filed: Jun. 21, 2001

(65) Prior Publication Data

US 2001/0054634 A1 Dec. 27, 2001

(30) Foreign Application Priority Data

Jun. 21, 2000 (JP) ..... 2000-185895

(51) Int. Cl.[7] ..... B27F 7/17
(52) U.S. Cl. ..... 227/155; 227/131; 227/2
(58) Field of Search ..... 227/2, 155, 131

(56) References Cited

U.S. PATENT DOCUMENTS 2,770,805 A 11/1956 Elzer et al.
4,623,082 A 11/1986 Kurosawa
4,720,033 A * 1/1988 Olesen ..... 227/131
4,726,505 A * 2/1988 Okazaki ..... 227/132
5,007,572 A 4/1991 Chung-Cheng
5,141,143 A * 8/1992 Ebner et al. ..... 227/129
5,460,314 A * 10/1995 Udagawa ..... 227/155
5,660,314 A * 8/1997 Magnusson et al. ..... 227/2
5,702,047 A * 12/1997 Yoshie ..... 227/131
5,791,548 A * 8/1998 Udagawa et al. ..... 227/131
5,836,502 A * 11/1998 Kanai et al. ..... 227/131

FOREIGN PATENT DOCUMENTS

EP 0 844 053 A2 5/1998 ..... B27F/7/31

* cited by examiner

*Primary Examiner*—Rinaldi I. Rada
*Assistant Examiner*—Tara Ho
(74) *Attorney, Agent, or Firm*—Chapman and Cutler LLP

(57) ABSTRACT

A motor-operated stapler capable of narrowing the range of a home position zone of a cam, is provided. The motor-operated stapler includes a driver 36 which reciprocates and drives out a staple toward a sheet bundle and a drive-out mechanism 30 which causes the driver 36 to operate. A driver cam 32 is mounted on a driving shaft 31 in the drive-out mechanism 30 and the driver 36 is reciprocated once by rotation of the driver cam 32. A brake mechanism 60 is used which applies a brake mechanically to the rotation of the driving shaft 31 when the driver 36 returns to its home position.

6 Claims, 12 Drawing Sheets

STAPLER WITH BRAKING MECHANISM

BACKGROUND OF THE INVENTION

1. Field of the Invention

The present invention relates to a motor-operated stapler having a driver which reciprocates and drives out a staple toward a sheet bundle.

2. Description of the Prior Art

Heretofore, such a motor-operated stapler as shown in FIG. 11 has been known. This known stapler is provided with a forming plate 1 for forming a staple in U shape, a driver 8 for driving out the U-formed staple toward a sheet bundle 2, a link mechanism 4 which causes the forming plate 1 and the driver 3 to reciprocate, and a table having a clincher (not shown) for clinching leg portions of the staple which has pierced the sheet bundle 2.

The link mechanism 4 has a link cam 6 mounted on a driving shaft 5 and a link member 8 mounted pivotably between a pair of frames 7. At a rear portion of the link member 8 is mounted a roller R rotatably in abutment against the link cam 6. The link member 8 is urged by means of a biasing member (not shown) in a direction in which the roller R is kept in abutment against the link cam 6. With rotation of the link cam 6, the link member 8 pivots about a shaft 8A, as shown in FIG. 12.

A shaft 9 is held in an elongated hole 8B formed in a front end portion of the link member 8. As the link member 8 pivots about the shaft 8A, the shaft 9 moves vertically along elongated holes 7A formed in the frames 7. The forming plate 1 and the driver 3 are secured to the shaft 9 and move vertically with a vertical movement of the shaft 9.

The link cam 6 is formed with a home position portion 6A for keeping the forming plate 1 and the driver 3 located at their position (home position) shown in FIG. 11, an advancing portion 6B for moving the forming plate 1 and the driver 3 downward and driving out a staple, a hold-down portion 6C for holding down the driven-out staple, and a retreating portion 6D for moving the forming plate 1 and the driver 3 upward. With one rotation of the link cam 6, the forming plate 1 and the driver 3 reciprocate once up and down.

In such a conventional motor-operated stapler, plural cams, etc. other than the link cam 6 are mounted on the driving shaft 5, so even when the motor turns OFF, the rotation of the driving shaft 5 does not stop immediately due to inertia for example. For this reason it has so far be necessary that the range of the home position portion (home position zone) 6A be taken wide. For example, even with use of a motor brake or the like, one-ninth or more of the entire rotational angle (360°) of the link cam 6 is needed and a rotational angle (an angle falling under the range of the advancing portion 6B) used for drive-out becomes narrower, thus giving rise to the problem that the rotational angle range used for other controls is narrowed.

Even if an attempt is made to rotate the link cam 6 with use of a dedicated motor as a separate drive source for diminishing inertia, a wide home position zone is required due to accumulation of accuracy errors in a transfer system for transferring the rotational force of the motor to the link cam.

SUMMARY OF THE INVENTION

It is an object of the present invention to provide a motor-operated stapler which permits narrowing the range of a home position zone of a cam.

According to the present invention there is provided a motor-operated stapler including a driver adapted to reciprocate and drive out a staple toward a sheet bundle and a drive mechanism for actuating the driver, the driver being reciprocated once with rotation of a driving cam mounted on a driving shaft in the drive mechanism, characterized by further including a brake means which brakes the rotation of the driving shaft mechanically when the driver returns to a home position thereof.

DETAILED DESCRIPTION OF THE EMBODIMENT

A motor-operated stapler embodying the present invention will be described hereunder with reference to the accompanying drawings.

Figure 1:
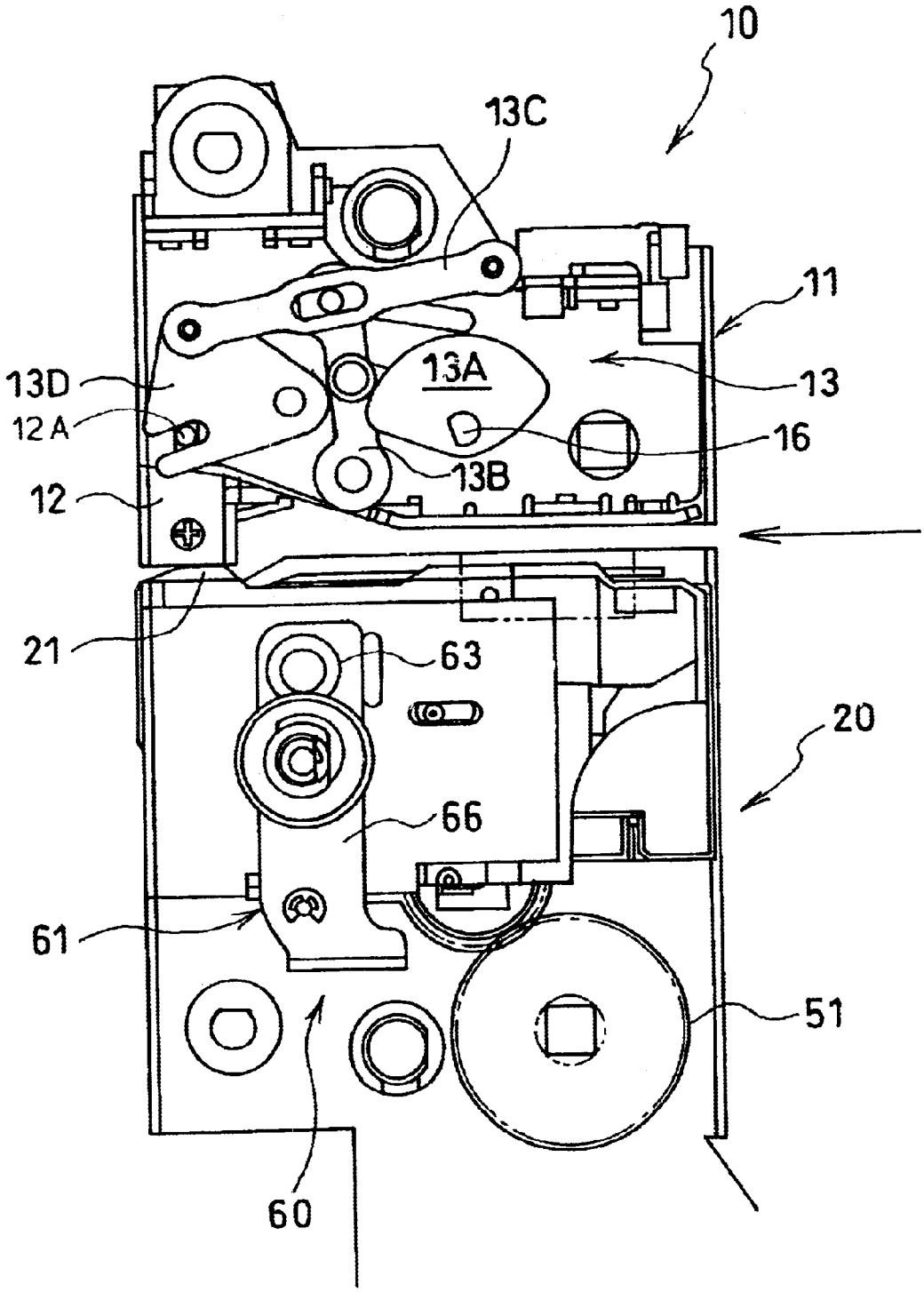
FIG. 1 is a side view showing an entire configuration of a motor-operated stapler according to the present invention.

In FIG. 1, the numeral 10 denotes a motor-operated stapler which is attached to a copying machine for example. The motor-operated stapler 10 is provided with a clincher unit 11 and a driver unit 20, the clincher unit 11 and the driver unit 20 being separated from each other.

Clincher Unit

The clincher unit 11 is provided with a clincher base 12 having a clincher (not shown), a vertical link mechanism 13 for moving the clincher base 12 vertically, and a clincher mechanism (not shown) for rotating the clincher.

Clincher Base

Figure 2:
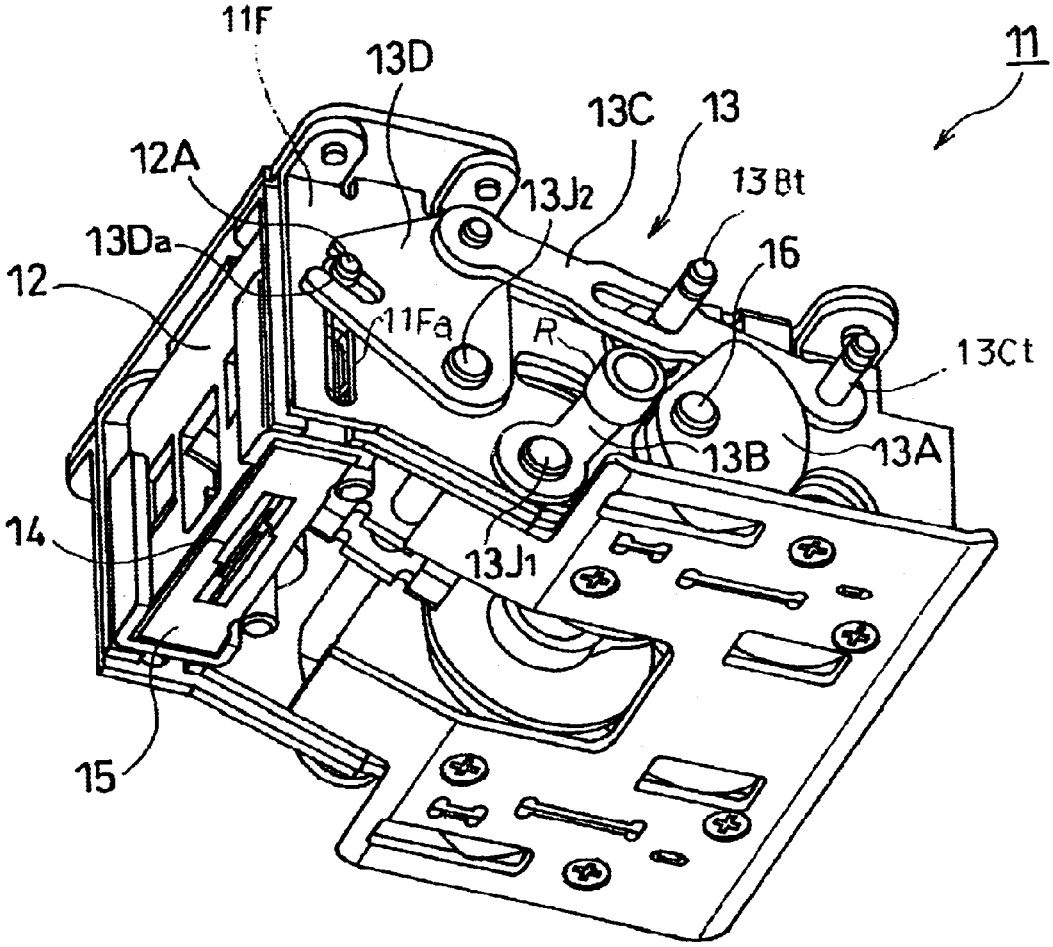
FIG. 2 is a perspective view showing a clincher unit.

As shown in FIG. 2, the clincher base 12 is moved downward by the vertical link mechanism 13 and holds a sheet bundle (not shown) between it and a drive-out section 21 in the driver unit 20, and it has a bottom 15 formed with an aperture 14 into which leg portions of a staple enter after piercing through the sheet bundle. The clincher clinches the leg portions of the staple which has entered the aperture 14.

Vertical Link Mechanism

Figure 3:
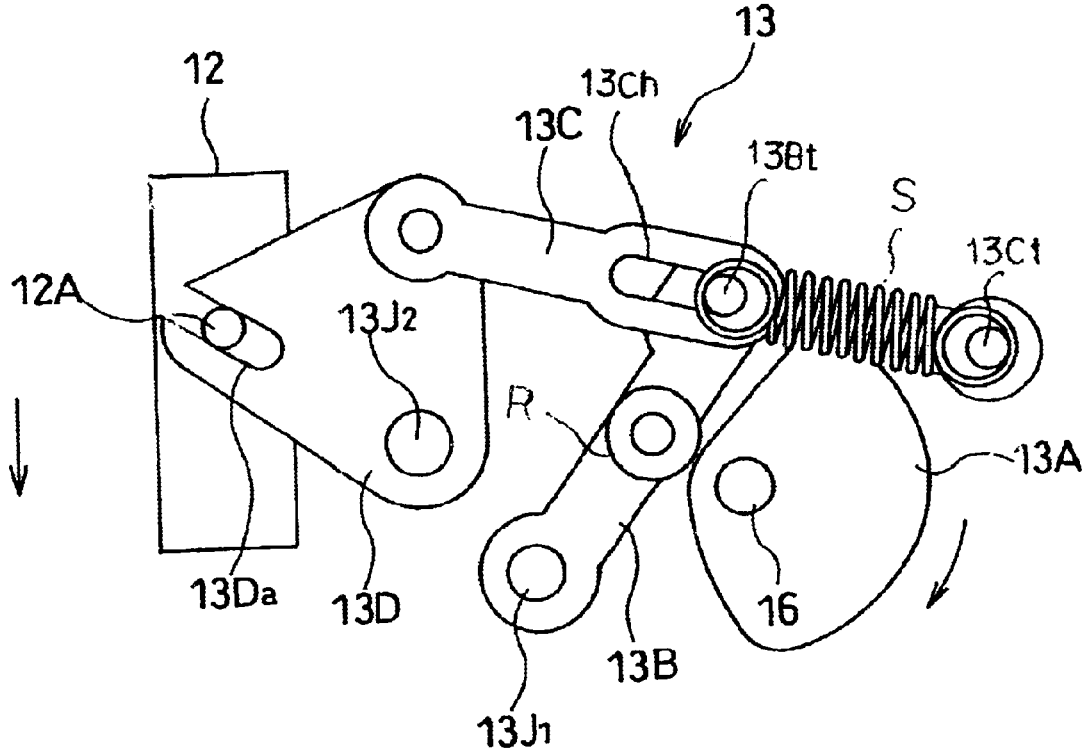
FIG. 3 is an explanatory diagram showing the configuration of a vertical link mechanism.

As shown in FIG. 3, the vertical link mechanism 13 is provided with a link cam 13A mounted on a driving shaft 16 which is rotated by means of a motor disposed in a drive mechanism (not shown), a first link member 13B adapted to rotate about a shaft 13J1, a second link member 13C, and a third link member 13D adapted to rotate about a shaft 13J2. On the left-hand side of the third link member 13D is formed an elongated hole 13Da which is inclined upward in the leftward direction and whose left end portion is open. A shaft 12A provided on the clincher base 12 is inserted through an elongated hole 11F a formed in a frame 11F of the clincher unit 11, as shown in FIG. 2.

A roller R is mounted on an intermediate portion of the first link member 13B and it is in abutment against the peripheral surface of the link cam 13A. A protrusion 13Bt is formed on an upper portion of the first link member 13B and it is inserted into an elongated hole 13Ch which is formed in an intermediate portion of the second link member 13C and which is for adjusting the paper thickness. The protrusion 13Bt is urged rightwards by means of a spring S so that the roller R is in abutment against the peripheral surface of the link cam 13A constantly. With the spring S, the third link member 13D is urged clockwise.

One end of the spring S is anchored to the protrusion 13Bt of the first link member 13B, while an opposite end thereof is anchored to a protrusion 13Ct provided at the right end portion of the second link member 13C.

Through the link cam 13A and the link members 13B to 13D, the clincher base 12 reciprocates once vertically as the driving shaft 16 rotates once.

Driver Unit

Figure 4:
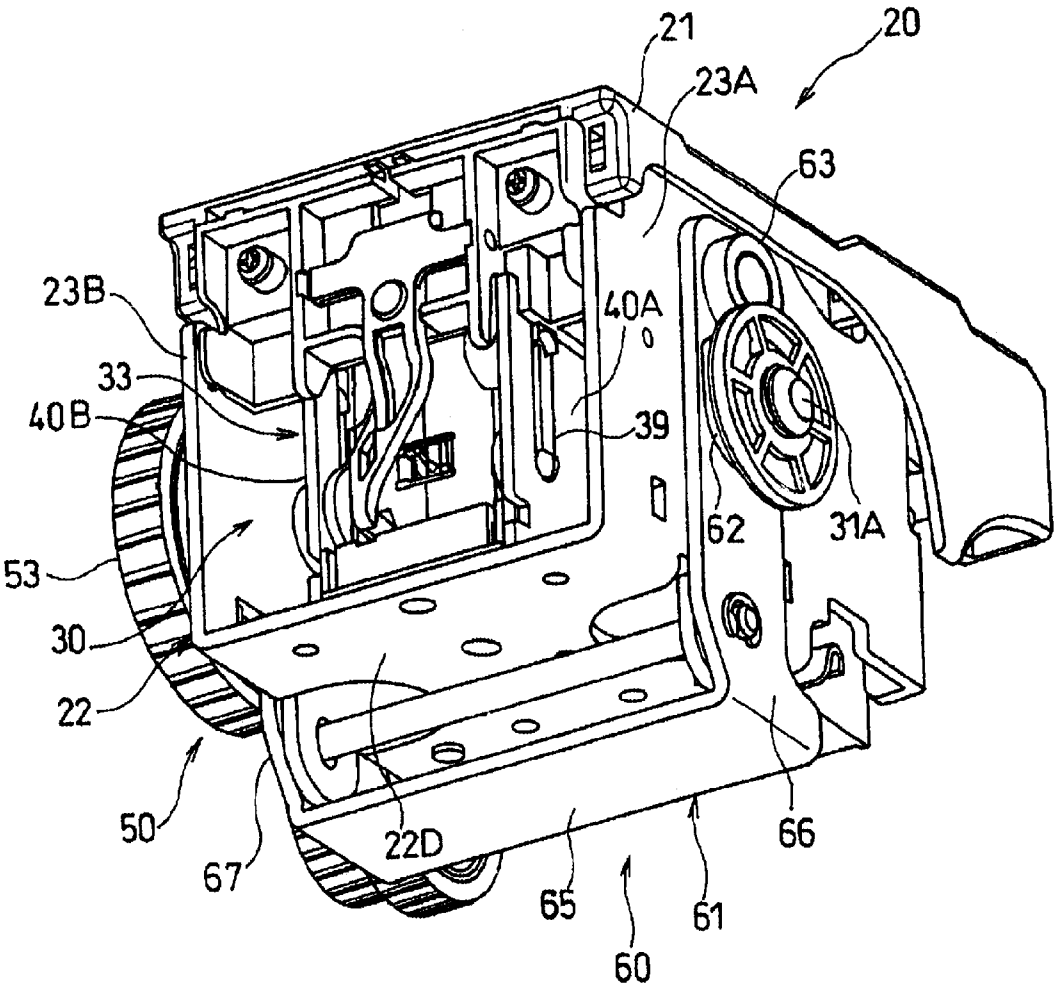
FIG. 4 is an explanatory diagram showing a driver unit.

As shown in FIG. 4, the driver unit 20 is provided with a drive-out mechanism 30 disposed inside a U-shaped frame 22, a cartridge (not shown) loaded removably into a magazine (not shown) which is provided in a sub frame 33 mounted inside the frame 22, a delivery mechanism (not shown) which sends out sheet staples stacked in the cartridge to the drive-out section, a drive mechanism 50 for driving the delivery mechanism and the drive-out mechanism 30, and a brake mechanism (brake means) 60. The drive mechanism 50 is secured to a side plate 23B of the frame 22.

Drive-out Mechanism

Figure 5:
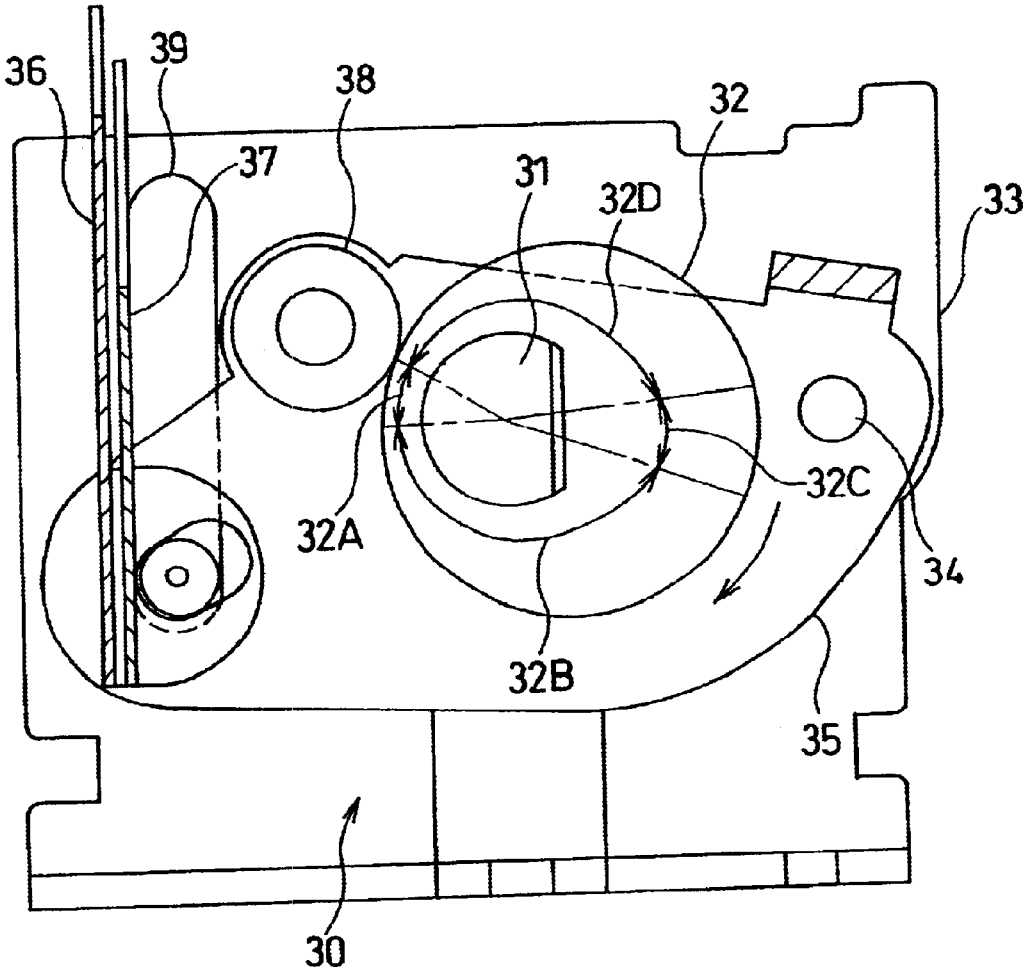
FIG. 5 is an explanatory diagram showing the configuration of a drive-out mechanism.

As shown in FIG. 5, the drive-out mechanism 30 is made up of a driver cam (driving cam) 32 mounted on a driving shaft 31, a driver link 35 mounted rotatably on a shaft 34 of the sub frame 33, and a driver 36 and a forming plate 37 both secured to the driver link 35. As is the case with the prior art, the driver cam 32 is formed with a home position portion 32A, an advancing portion 32B for driving out a staple, a hold-down portion 32C for holding down the driven-out staple, and a retreating portion 32D for moving the forming plate 37 and the driver 36 downward.

A roller 38 is provided on the driver link 35 rotatably, the roller 38 being in abutment against the peripheral surface of the driver cam 32. As the driver cam 32 rotates, the driver link 35 turns about the shaft 34, thereby causing the driver 86 and the forming plate 37 to move vertically along an elongated hole 39 formed in the sub frame 33. Thus, while the driver cam 32 rotates once, the driver 36 and the forming plate 37 reciprocate once vertically.

Drive Mechanism

Figure 6:
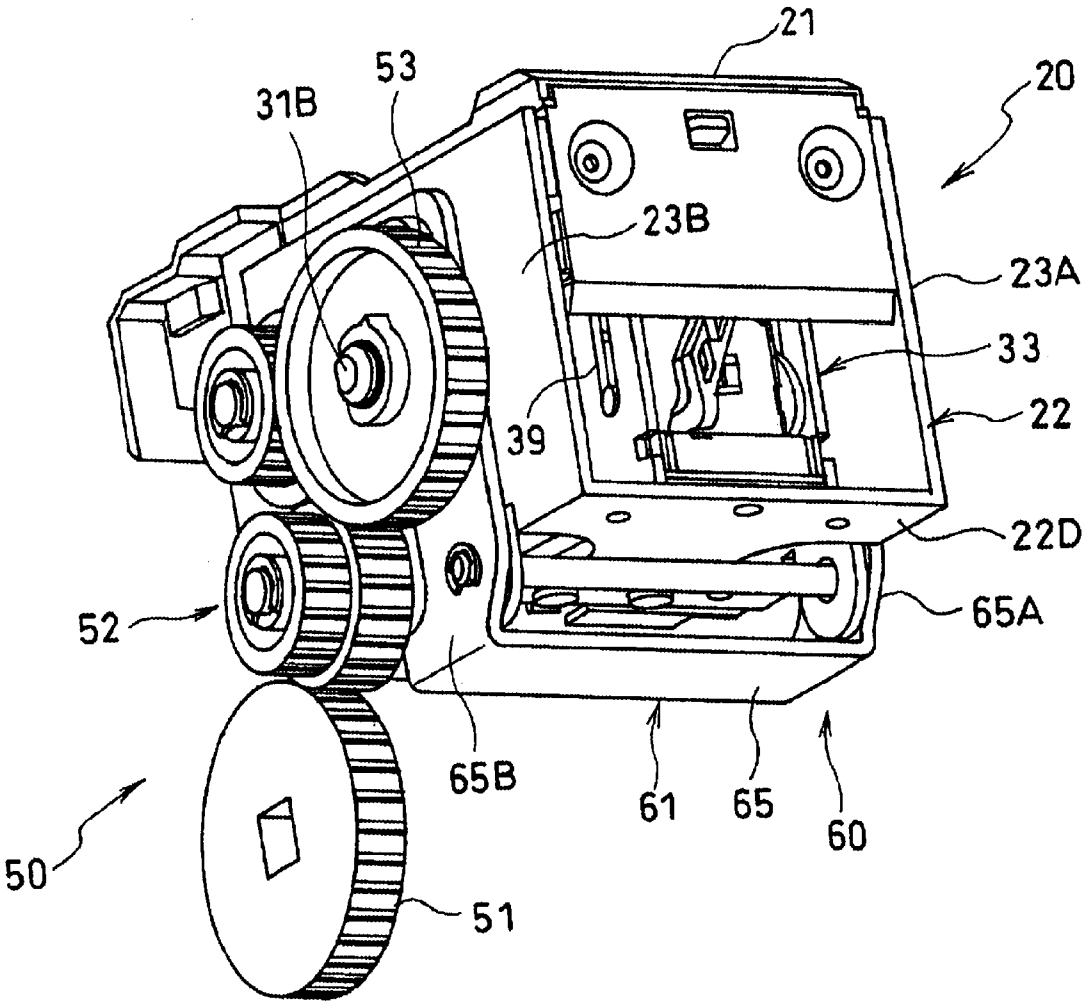
FIG. 6 is a perspective view showing the configuration of a drive mechanism.
Figure 7:
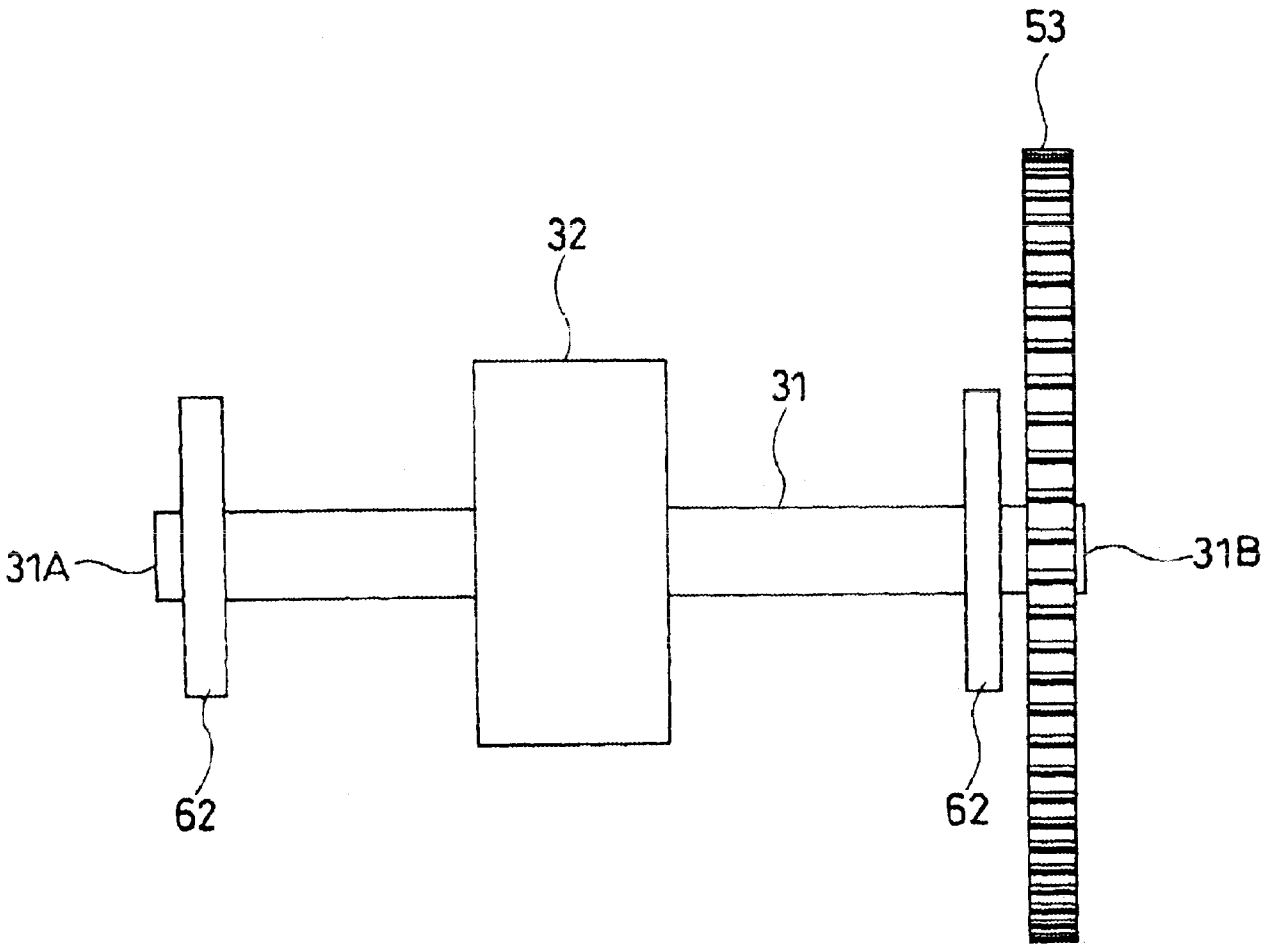
FIG. 7 is an explanatory diagram showing a driver cam, a brake cam, and a driven gear which are mounted on a driving shaft.

As shown in FIG. 6, the drive mechanism 50 is provided with a driving gear 51 mounted on a motor shaft of a motor (not shown), a reduction gear train 52 engaged with the driving gear 51, and a driven gear 53 engaged with the reduction gear train 52. As shown in FIG. 7, the driven gear 53 is mounted on one end 31B of the driving shaft 31. The driving shaft 31 extends through side plates 23A, 23B of the frame 22 and side plates 40A, 40B of the sub frame 33 and both ends 31A, 31B thereof project to the outside of the side plates 23A and 23B (see FIG. 9). The driving shaft 31 is held rotatably by the side plates 23A and 23B of the frame 22.

Brake Mechanism

Figure 8:
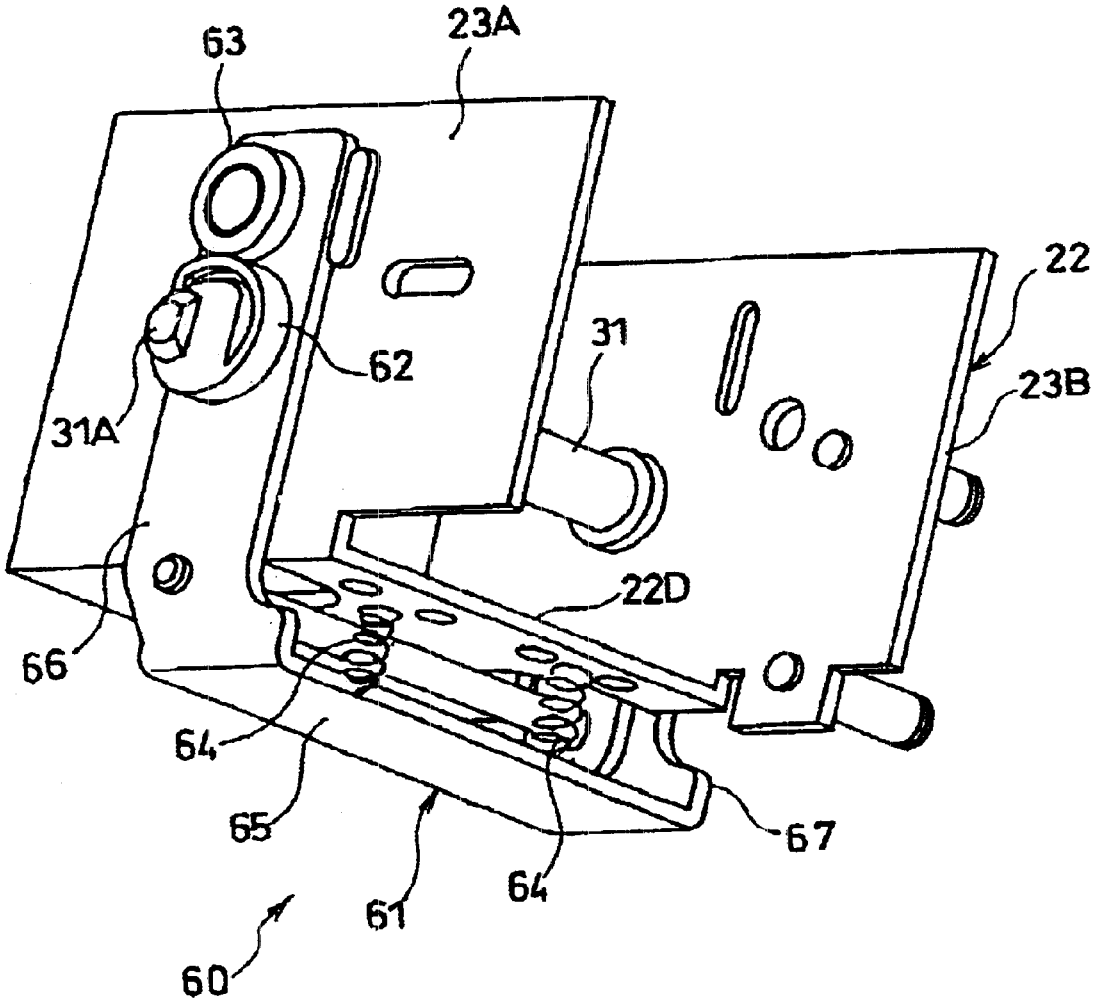
FIG. 8 is a perspective view showing the configuration of a brake mechanism.
Figure 9:
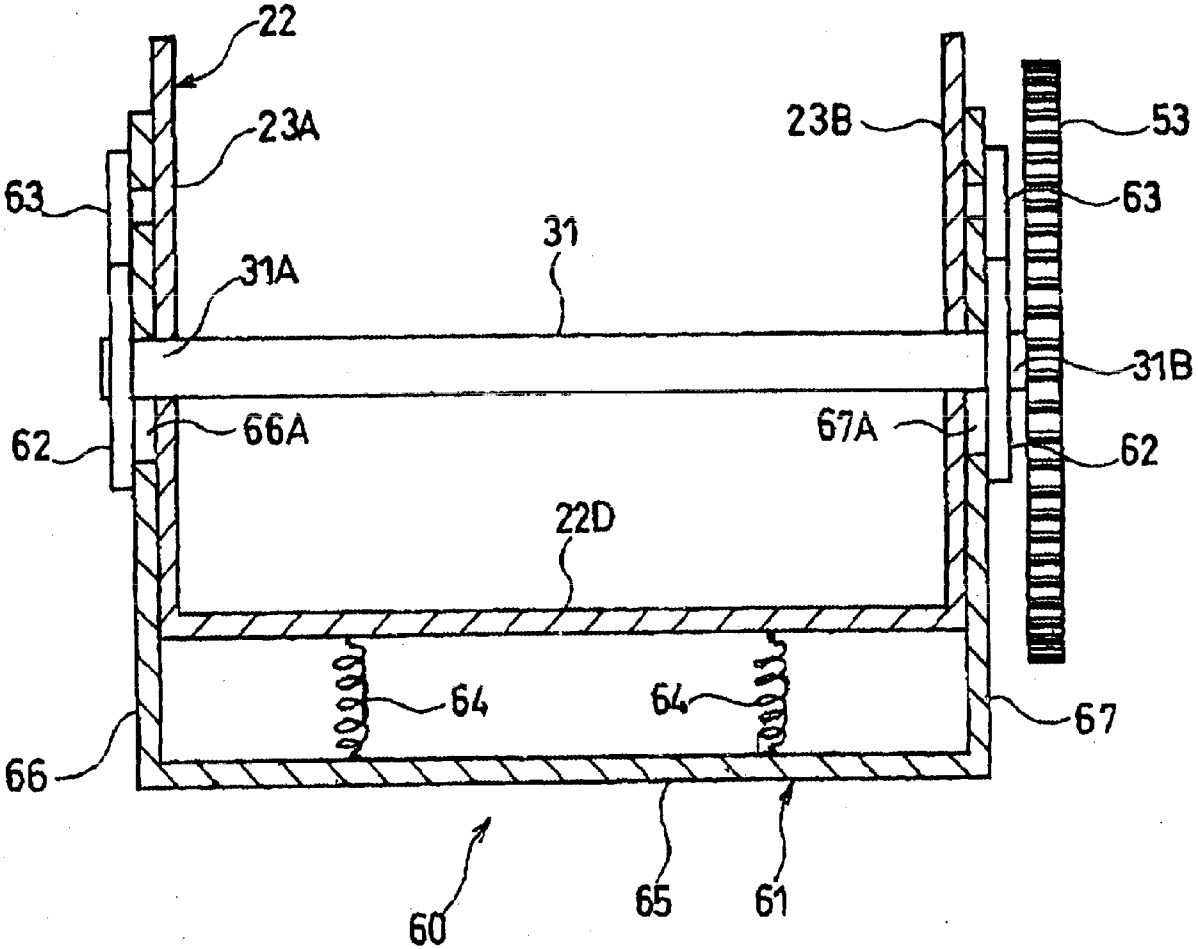
FIG. 9 is a sectional view showing the configuration of the brake mechanism.

As shown in FIGS. 8 and 9, the brake mechanism 60 is made up of a brake frame 61 mounted outside the frame 22 vertically movably, a brake cam 62 mounted on the opposite end 31A of the driving shaft 31, a roller (brake member) 63 abutted against the brake cam 62, and springs (urging members) 64 disposed between a bottom 22D of the frame 22 and a base plate 65 of the frame 61 to urge the brake frame 61 downward, allowing the roller 63 to come into pressured contact with the brake cam 62.

The brake frame 61 has side plates 66 and 67 erected on both ends of the base plate 65, with vertically elongated holes 66A and 67A being formed in side plates 66 and 67, respectively. Both the end portions 31A and 31B of the driving shaft 31 are inserted into the elongated holes 66A and 67A, which holes permit a vertical movement of the brake frame 61.

Figure 10:
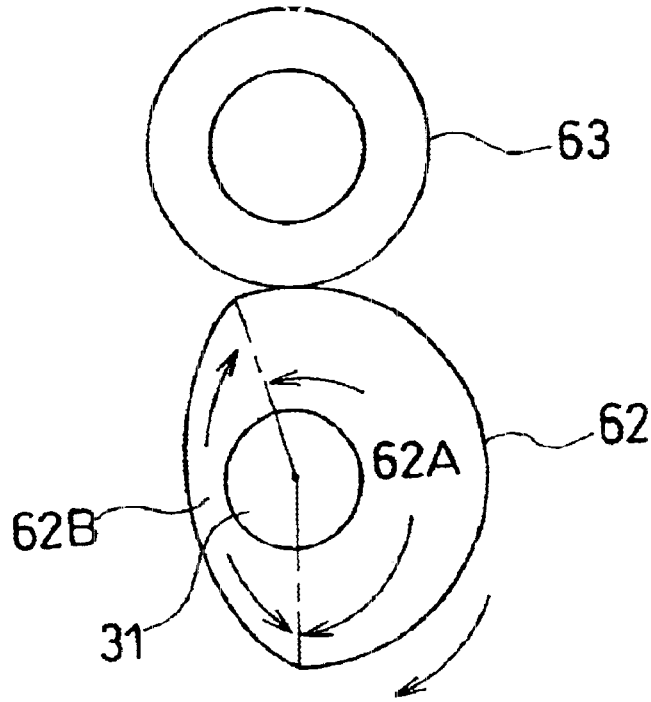
FIG. 10 is an explanatory diagram showing the brake cam and a roller.
Figure 11:
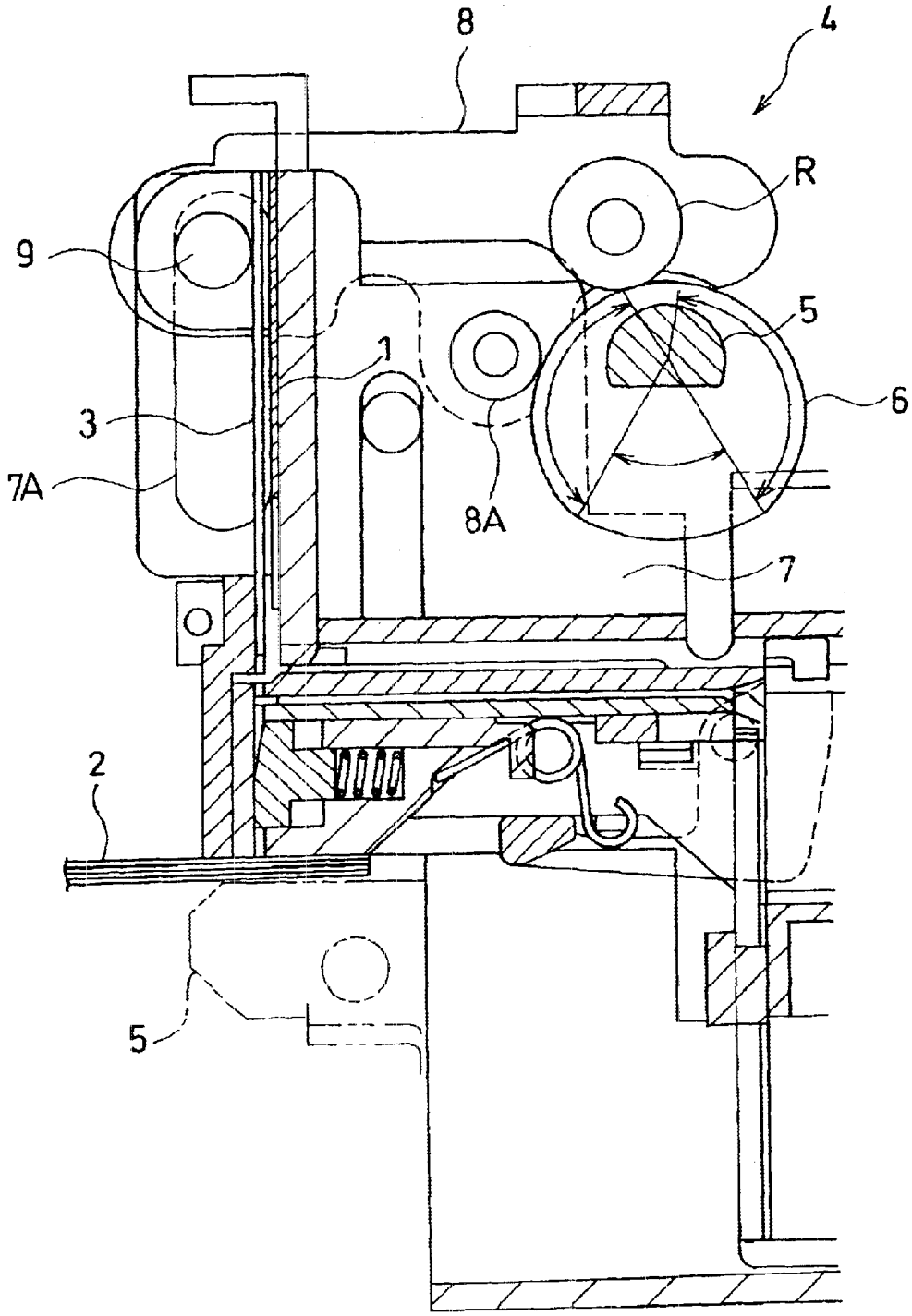
Prior Art Fig. 11
FIG. 11 is an explanatory diagram showing a part of a conventional motor-operated stapler.
Figure 12:
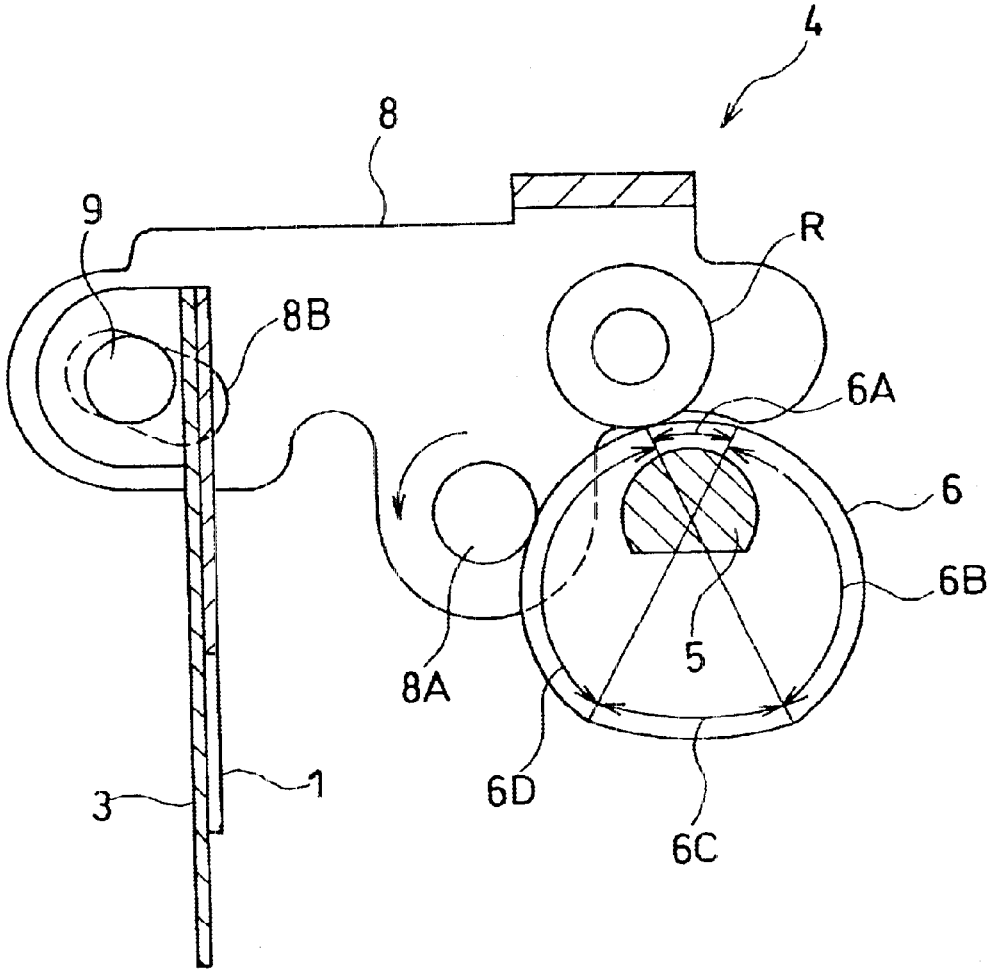
Prior Art Fig. 12
FIG. 12 is an explanatory diagram showing the configuration of a conventional link mechanism 4.

As shown in FIG. 10, the brake cam 62 has a large-diameter portion 62A and a small-diameter portion 62B. During ascent of the driver 36 and the forming plate 37, the roller 63 is put in abutment against the small-diameter portion 62B of the brake cam 62, while during descent of the driver 36 and the forming plate 37 and also when they assume their home position, the roller 63 is put in abutment against the large-diameter portion 62A of the brake cam 62. The roller 63 is secured to the side plate 66A of the brake frame 61 rotatably.

The brake mechanism 60 is also provided on the side plate 23B side of the frame 22.

Operation

Next, the operation of the motor-operated stapler 10 of this embodiment will be described below.

When a sheet bundle (not shown) is discharged from a copying machine (not shown) and a stapling signal is outputted from the copying machine, a motor in a drive mechanism of the clincher unit 11 is turned ON and the driving shaft 16 rotates. With this rotation of the driving shaft 16, the vertical link mechanism 13 causes the clincher base 12 to move down. The sheet bundle is pinched by both the clincher base 12 which has thus descended and the drive-out section 21 of the driver unit 20.

Thereafter, a drive motor in the driver unit 20 is turned ON to rotate the driving shaft 31. With this rotation (clockwise rotation in FIG. 5) of the driving shaft 31, the advancing portion 32B of the driver cam 32 comes into abutment against the roller 38. During this period, the driver link 35 turns clockwise about the shaft 34 and both the driver 36 and forming plate 37 move upward. As the forming plates 37 rises, a staple (not shown) is formed in U shape and a staple (not shown) which has already been formed in U shape by the previous rise of the forming plate 37 is driven out from the drive-out section 21 as the driver 36 rises.

Leg portions of the staple thus driven out from the drive-out section 21 pierce through the sheet bundle and enter the aperture 14 formed in the clincher base 12. The clincher mechanism in the clincher base 12 clinches the leg portions of the staple which has entered the aperture 14. During this clinching period, the hold-down portion 32C of the driver cam 32 comes into abutment against the roller 38 and holds down the staple which has been driven out by the driver 36.

On the other hand, as the driving shaft 31 rotates, the brake cam 62 turns clockwise (in FIG. 10), so that the small-diameter portion 62B of the brake cam 62 comes into abutment against the roller 63 while the advancing portion 32B and hold-down portion 32C of the driver cam 32 are in abutment against the roller 38, that is, during the period from the start of upward movement of the driver 36 and the forming plate 37 until the end thereof. Consequently, the brake frame 61 moves down from its home position shown in FIG. 9 with the biasing force of the spring 64. As a result, the force with which the roller 63 comes into pressured contact with the brake frame 61 becomes smaller and there is little braking force applied to the rotation of the driving shaft 31. Thus, the staple driving-out operation is not influenced at all.

When the clinching for the staple leg portions is completed, the retreating portion 32D of the driver cam 32 comes into abutment against the roller 38 and the driver link 35 turns counterclockwise about the shaft 34. With this counterclockwise rotation of the driver link, the driver 36 and the forming plate 37 move down.

With this downward movement, the large-diameter portion 62A of the brake cam 62 comes into abutment against the roller 63 and the brake frame 61 moves upward against the biasing force of the spring 64. With this upward movement, the force with which the roller 63 comes into pressured contact with the brake frame 61 becomes larger. As a result, a braking force is applied to the rotation of the driving shaft 31 and increases, so that the rotational speed of the driving shaft 31 decreases. Since a large load is not imposed on the motor during downward movement of the driver 36 and the forming plate 37, there will occur no problem even if the braking force is applied to the driving shaft 31.

When the driver 36 and the forming plate 37 return to their home position, the brake frame 61 reaches its top dead center, the braking force thereof becomes maximum and the rotational speed of the driving shaft 31 becomes minimum. Therefore, even if the motor is turned OFF when the driver 36 and the forming plate 37 have returned their home position, it is possible to let the driving shaft 31 stop positively at a predetermined position, in other words, the position at which the roller 38 comes into abutment against the home position portion 32A of the driver cam 32.

That is, it is possible to prevent overrun and let the driver 36 and the forming plate 37 stop surely at their home position.

Thus, since a braking force is applied to the driving shaft 31 during descent of the driver 36 and the forming plate 37, it is not necessary to use the motor brake. Besides, since the braking force is increased with their descent, it is possible to surely prevent overrun and let the driver 36 and the forming plate 37 stop surely at their home position. Therefore, it is possible to narrow the range of the home position portion (home position zone) 32A of the driver cam 32 and widen the range of the advancing portion 32B of the driver cam 32.

In the above embodiment, moreover, since the spring 64 is used for applying the braking force to the driving shaft 31, the configuration is simple and it is possible to provide an inexpensive motor-operated stapler.

Further, although in the motor-operated stapler 10 of the above embodiment, the clincher unit 11 and the driver unit 20 are formed as separate units, it goes without saying that both may be formed in one piece with each other.

What is claimed is:

1. A stapler with a braking mechanism, comprising:

a driver adapted to reciprocate for driving out a staple toward a sheet bundle;

a drive mechanism for actuating the driver, said drive mechanism including a driving shaft and a driving cam mounted on said driving shaft for moving said driver; and a means for braking which brakes the rotation of said driving shaft mechanically when said driver returns to a home position thereof.

2. A stapler with a braking mechanism, comprising:

a driver adapted to reciprocate for driving out a staple toward a sheet bundle;

a drive mechanism for actuating the driver, said drive mechanism including a driving shaft and a driving cam mounted on said driving shaft for moving said driver; and a means for braking which brakes the rotation of said driving shaft mechanically when said driver returns to a home position thereof;

wherein said means for braking comprises a brake cam mounted on said driving shaft, a brake member which is put in abutment against said brake cam, and a biasing member which urges said brake member in a direction in which the brake member comes into pressured contact with said brake cam, and when said driver returns to its home position, the force with which said brake member comes into pressured contact with said brake cam is increased to brake said driving shaft.

3. A stapler with a braking mechanism according to claim 2, wherein said brake cam has a large-diameter portion and a small-diameter portion, and when said driver returns to its home position, said brake member is brought into abutment against said large-diameter portion of the brake cam.

4. A stapler with a braking mechanism according to claim 3, wherein a brake frame is attached vertically movably to a frame which holds said driving shaft rotatably, said brake frame being urged downward by said biasing member, and said brake member is provided on said frame and is brought into pressured contact with said brake cam downward from above.

5. A stapler with a braking mechanism according to claim 2, wherein said brake member is a roller.

6. A stapler with a braking mechanism according to claim 2, wherein said biasing member is a spring.

* * * * *